US005609509A

United States Patent [19]

Stamos

[11] Patent Number: 5,609,509

[45] Date of Patent: Mar. 11, 1997

[54] AMUSEMENT AND RECREATIONAL APPARATUS

[76] Inventor: Bryan W. Stamos, 900 Pinot Noir, Lodi, Calif. 95240

[21] Appl. No.: 582,674

[22] Filed: Jan. 4, 1996

Related U.S. Application Data

[63] Continuation-in-part of Ser. No. 419,891, Apr. 11, 1995, Pat. No. 5,536,195, which is a continuation-in-part of Ser. No. 321,249, Oct. 11, 1994, abandoned.

[51] Int. Cl.[6] ..... A63H 33/22; A63H 1/06; G09F 13/00; F21V 21/30

[52] U.S. Cl. ..... 446/219; 446/241; 40/433; 362/34; 362/35

[58] Field of Search ..... 446/219, 241, 446/242, 46, 47, 48, 485; 40/433, 431, 427; 362/34, 35, 84, 234, 811

[56] References Cited

U.S. PATENT DOCUMENTS

| | | | |
|---|---|---|---|
| D. 209,763 | 1/1968 | Mueller . | |
| 2,628,094 | 2/1953 | Matrejek | 446/241 |
| 3,948,523 | 4/1976 | Michael . | |
| 3,971,158 | 7/1976 | Hanson | 446/242 |
| 4,086,723 | 5/1978 | Strawick . | |
| 4,097,917 | 6/1978 | McCaslin | 362/811 X |
| 4,204,357 | 5/1980 | Harrington . | |
| 4,207,702 | 6/1980 | Boatman et al. . | |
| 4,254,575 | 3/1981 | Gould . | |
| 4,515,570 | 5/1985 | Beltran . | |
| 5,181,876 | 1/1993 | Chen et al. . | |
| 5,387,146 | 2/1995 | Smith et al. | 446/219 X |

*Primary Examiner*—Mickey Yu
*Attorney, Agent, or Firm*—Thomas R. Lampe

[57] ABSTRACT

An amusement and recreational apparatus includes a rotatable support having at least one elongated flexible member in engagement therewith which includes a flexible light transmitting portion spaced from the rotatable support. Chemiluminescent liquid material is disposed within the interior of the flexible light transmitting portion. Structure is provided to rotate the rotatable support. The elongated flexible member changes shape during rotation to provide a variable light display.

12 Claims, 3 Drawing Sheets

AMUSEMENT AND RECREATIONAL APPARATUS

This application is a continuation-in-part of U.S. patent application Ser. No. 08/419,891, filed Apr. 11, 1995, U.S. Pat. No. 5,536,195, issued Jul. 16, 1996, the latter being a continuation-in-part of U.S. patent application Ser. No. 08/321,249, filed Oct. 11, 1994, abandoned.

TECHNICAL FIELD

This invention relates to an amusement and recreational apparatus, more particularly to apparatus which includes a rotatable support having light emitting structure operatively associated therewith which provides a varying light display when the rotatable support is rotated.

BACKGROUND ART

Above referenced U.S. patent application Ser. No. 08/419,891 discloses an amusement and recreational apparatus in the form of an aerodynamic flying disc to be launched by hand as well as structure for illuminating the flying disc. The apparatus includes a container releasably attached to the flying disc having chemiluminescent liquid material within the interior thereof. Rotation of the flying disc serves to agitate the luminescent liquid material, and the light generated by the chemiluminescent liquid material is visually perceived during flight of the disc.

The following patents are believed to be representative of the current state of the prior art in the field: U.S. Pat. No. 4,207,702, issued Jun. 17, 1980, U.S. Pat. No. 5,181,876, issued Jan. 26, 1993, U.S. Pat. No. 4,515,570, issued May 7, 1985, U.S. Pat. No. 4,086,723, issued May 2, 1978, U.S. Pat. No. 4,204,357, issued May 27, 1980, U.S. Pat. No. 4,254,575, issued Mar. 10, 1981, U.S. Pat. No. 3,948,523, issued Apr. 6, 1976, and U.S. Pat. No. Des. 209,763, issued Jan. 2, 1968.

DISCLOSURE OF INVENTION

The present invention relates to amusement and recreational apparatus incorporating structural elements which provide an attractive light display which varies during use of the apparatus. The amusement and recreational apparatus of the present invention includes a rotatable support rotatable about a support axis of rotation and defining at least one opening spaced from the support axis of rotation.

At least one elongated flexible member is in engagement with and supported by the rotatable support. The at least one elongated flexible member has a flexible light transmitting portion spaced from the rotatable support and defining an interior close to the ambient atmosphere.

Chemiluminescent liquid material is disposed within the interior of the flexible light transmitting portion. The at least one elongated flexible member extends through the at least one opening defined by the rotatable support spaced from the support axis of rotation. The flexible light transmitting portion projects from the at least one opening spaced from the support axis of rotation whereby rotation of the rotatable support causes the flexible light transmitting portion to flex and move outwardly away from the support axis of rotation under centrifugal force to provide a variable light display from chemiluminescent light material within the interior of the flexible light transmitting portion.

Means is provided for imparting rotational movement to the rotatable support and the at least one elongated flexible member in engagement with and supported by the rotatable support.

Other features, advantages, and objects of the present invention will become apparent with reference to the following description and accompanying drawings.

MODES FOR CARRYING OUT THE INVENTION

Figure 1:
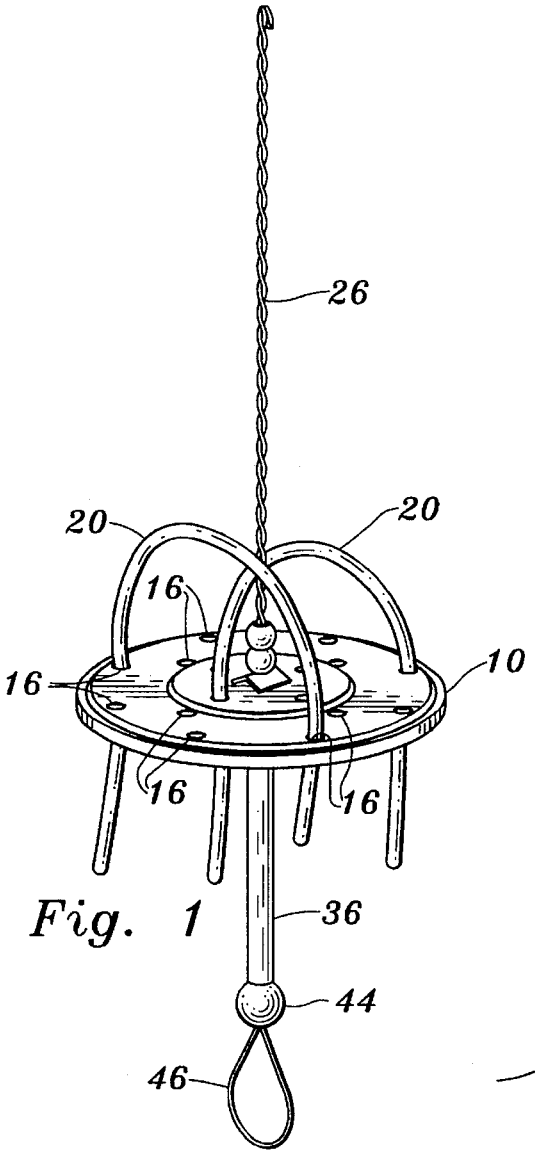
FIG. 1 is a perspective view of apparatus constructed in accordance with the teachings of the present invention.

FIGS. 1–7 illustrate one form of apparatus constructed in accordance with the teachings of the present invention. More particularly, the apparatus includes a rotatable support 10 generally in the form of a disc or plate. Support 10 may be formed of any suitable material, for example plastic. Rotatable support 10 has a hole 12 located at the center thereof which allows the rotatable support to rotate about a support axis of rotation located at the hole, as will be described in greater detail below.

Support 10 also defines a plurality of openings 16 which are spaced from one another and also from the support axis of rotation.

In FIGS. 1 and 3–5, two elongated flexible members 20 are in engagement with and supported by the rotatable support. Each member 20 is in the form of a tube formed of flexible, light-transmitting material such as clear plastic. Each member 20 is woven through two spaced openings 16 so that the upper portion of each member 20 is bowed and forms an arch extending between two openings.

Each member 20 has two free ends which project below the rotatable support 10. Thus, the only point of contact between each member 20 and the rotatable support is at the locations of the openings through which the member passes, the remainder of the member being spaced from the rotatable support.

Each tube-like member 20 defines an interior closed to the ambient atmosphere. Chemiluminescent liquid material is located within the interior of each tube. The precise nature of the chemiluminescent fluid and the components thereof are not important; however, such material is preferably non-toxic. Such chemicals are well known. For example, a first chemiluminescent fluid component suitable for use in connection with the present invention is a mixture of Dibutyl Phthalate, CPPO (bis(2,4,5- trichloro-6-carbopentoxy-phenyl)oxalate) and CBPEA (1-chloro- 9,10-bix(phenylethynyl)-anthracene). A suitable second chemiluminescent fluid component is a mixture of Dimethyl Phthalate, T-butyl Alcohol, hydrogen peroxide ($H_2O_2$), and Sodium Salicylate.

In practice, the components are mixed just prior to use and it will be assumed that any of the well known systems for mixing such components can be utilized. For example, it is well known to contain one of the components in a frangible capsule or container within the main container elongated flexible member that is fractured just prior to use to bring the components into contact and cause illumination. In the interest of simplicity, such an arrangement has not been illustrated and forms no part of the present invention.

If desired, different mixes may be utilized in different elongated flexible members to provide different colors, for example. The configuration and numbers of the elongated flexible members employed in the embodiment under discussion can be varied at the will of the operator to achieve different configurations and effects. Use of two elongated flexible members, each of which projects through two openings 16, is for purposes of illustration only.

Rotatable support 10 is mounted on an elongated structural element 26 which in the form illustrated comprises a wire which is wrapped about itself to form a helical outer surface. The wire is suitably formed of metal and is of sufficient gauge to provide strength and rigidity to the elongated structural element 26.

Element 26 passes through hole 12 in the rotatable support. Positioned above the rotatable support 10 and about the elongated structural element 26 is a member 28 which cooperates with the elongated structural element and the rotatable support to impart rotational movement to the rotatable support when the rotatable support is moved axially relative to the elongated structural element.

Member 28 includes a slit 30 which generally conforms to the cross-section of elongated structural element 26 so that the member 28 is forced to rotate when it is pushed along the elongated structural element. Such rotational movement is imparted to the rotatable support due to the frictional engagement between the member 28 at the distal ends thereof with the upper surface of the rotatable support. Such frictional engagement will be maintained when the rotatable support is pushed upwardly along with the member 28 relative to the elongated structural element. This is accomplished by means of a tubular-shaped pusher element 36 deployed about elongated structural element 26 and under rotatable support 10. Mechanisms of this general type have been employed in the past to rotate various types of structure including toys incorporating a rotatable member. The precise mechanism to impart rotational movement to the rotatable support 10 is not critical insofar as the present invention is concerned and any suitable means may be utilized for such purpose. For example, rotation may be effected by a motor.

A flat washer 40 is disposed between the pusher member 36 and the rotatable support and spherical-shaped washers 42 are disposed about the elongated structural element 26 above member 28. A knob 44 is also shown disposed between the lower loop or handle 46 of the elongated structural element 26 and the pusher member. The washers and knob provide a pleasing appearance, and in some measure at least the washers 40, 42 help to promote spinning of the rotatable support and member 28 by preventing direct engagement between some of the rotating structural elements and fixed structural elements of the device.

Figure 3:
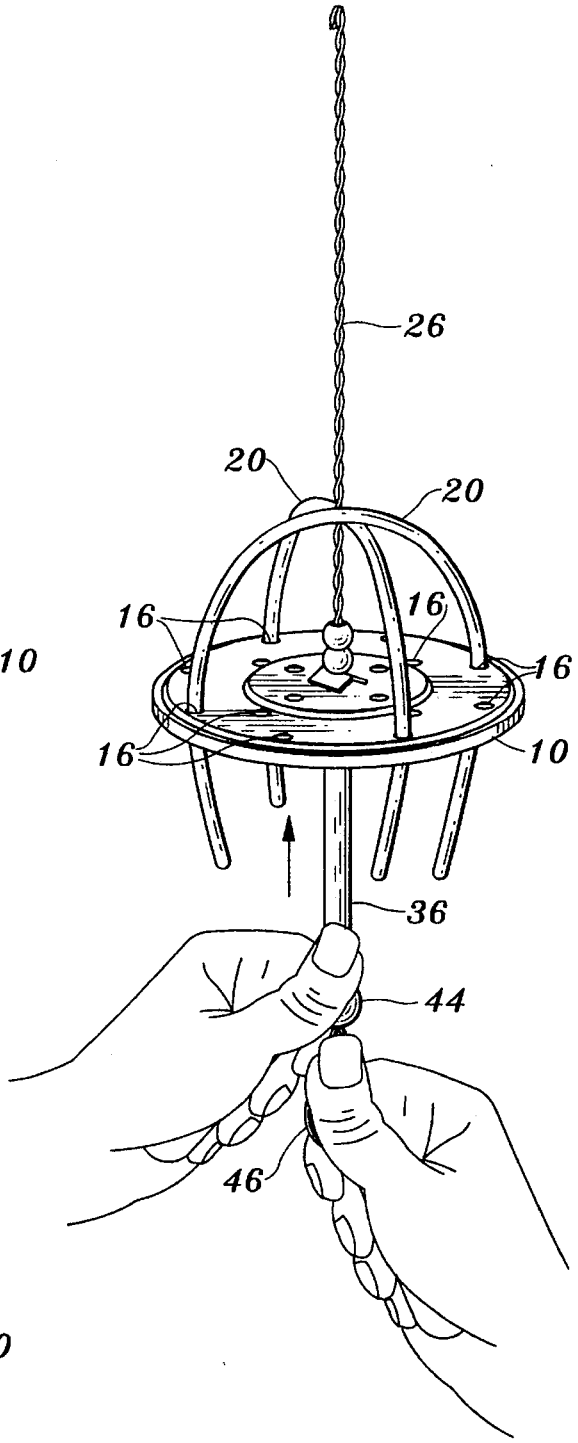
FIGS. 3 through 5 are perspective views illustrating manual manipulation of the apparatus and illustrating the condition of the structural components of the apparatus during sequential stages of operation thereof.
Figure 2:
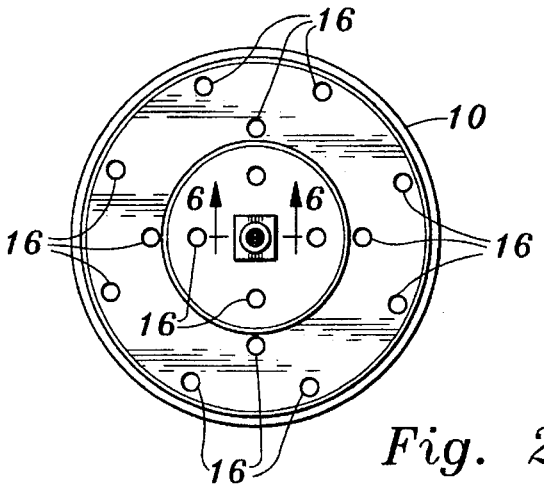
FIG. 2 is a top plan view of the apparatus.
Figure 4:
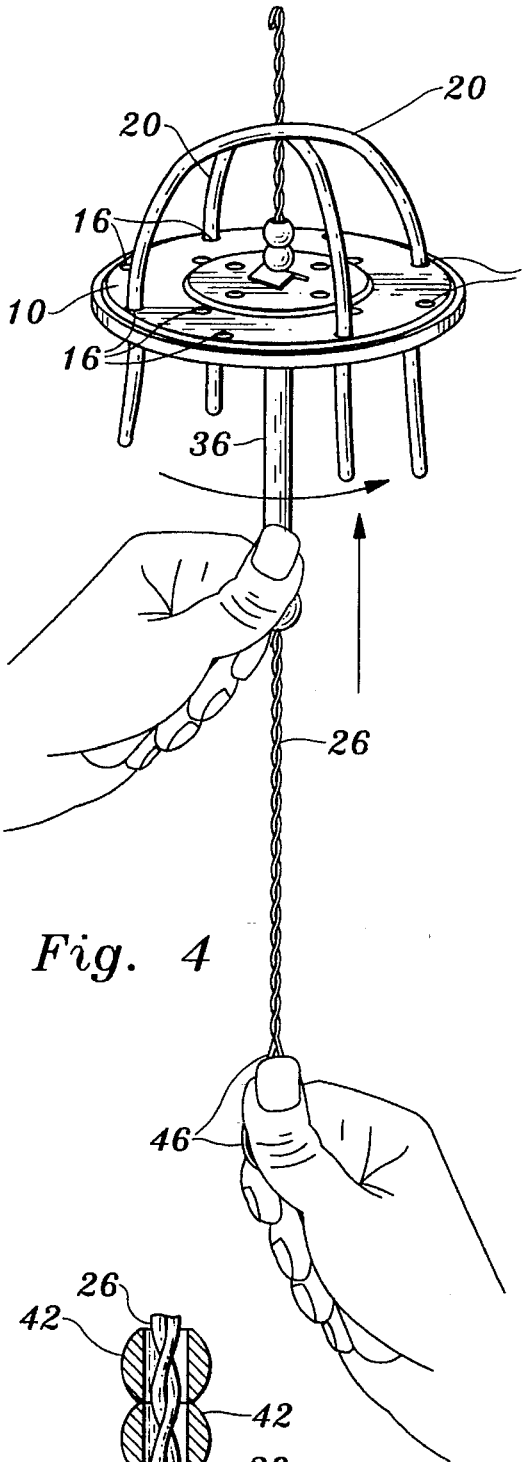
Figure 6:
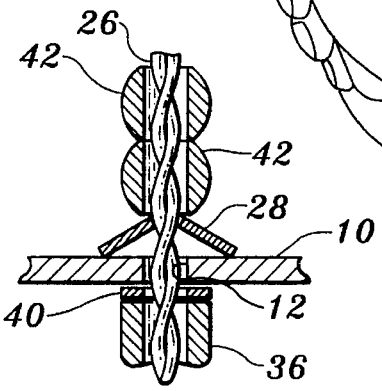
FIG. 6 is a greatly enlarged cross-sectional view taken along the line 6—6 in FIG. 2.
Figure 5:
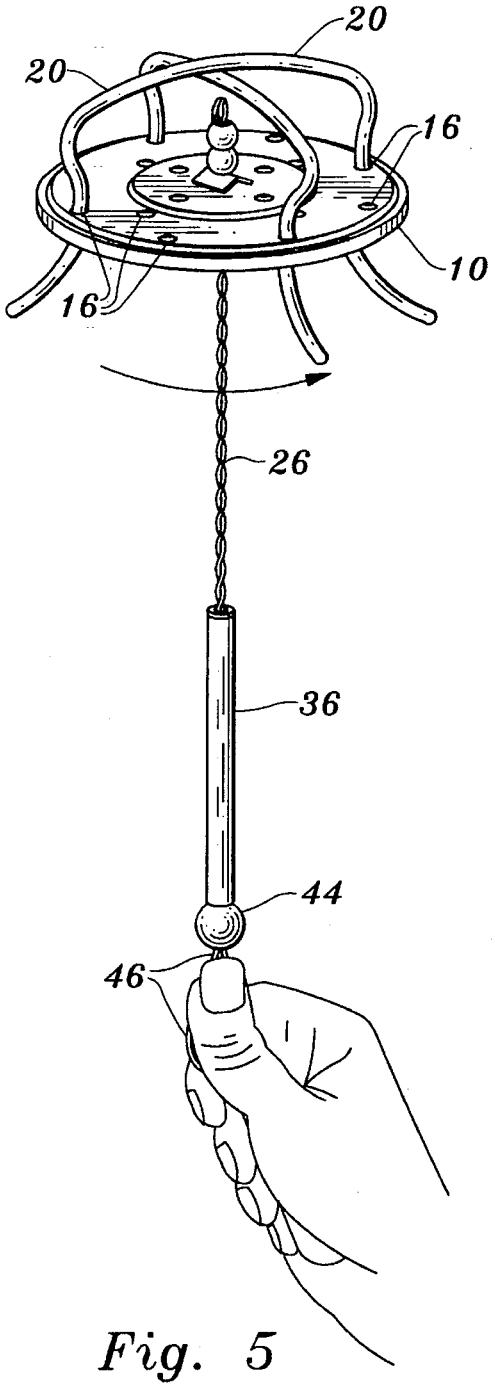
Figure 7:
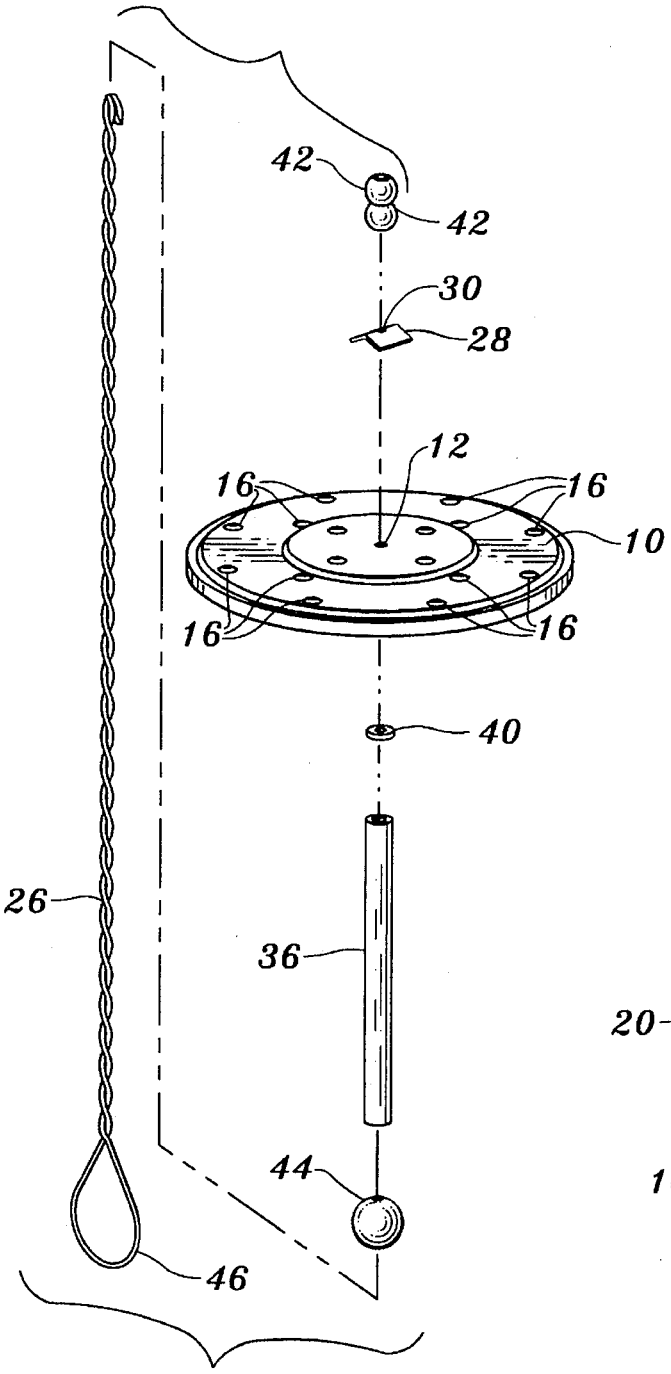
FIG. 7 is an exploded, perspective view illustrating the components of the apparatus.

FIG. 3 shows the condition of the apparatus at the time an individual first exerts an upwardly directed force on pusher member 36. This force will cause the rotatable support and the elongated flexible members carried thereby to move along the elongated structural element 26 away from handle 46 thereof. Interaction between the member 28 and the elongated structural element will cause the member 28 and the rotatable support 10 frictionally engaged thereby to rotate as shown in FIG. 4. This will cause centrifugal forces to act upon the elongated flexible members 20 and cause the outer ends thereof to move outwardly as shown in FIG. 5. Furthermore, the portions of the elongated flexible members above the rotatable support will flex under the centrifugal forces applied thereto and change the shapes of the arches thereof. Thus, an interesting variable light display which changes as the rotational speed changes is provided. Rotation of the rotatable support 10 also agitates and contributes to the mixing of the chemiluminescent liquid material within the closed interiors of members 20 to increase their effectiveness and enhance the illumination effect. The elongated flexible members will revert back to their original configurations when rotation stops.

Additional variation in the light display can be provided by the operator changing the configurations of the elongated flexible members relative to the rotatable support between spinning. Frictional engagement between the rotatable support and the elongated flexible members will maintain such relationship until readjustment by the user.

Figure 8:
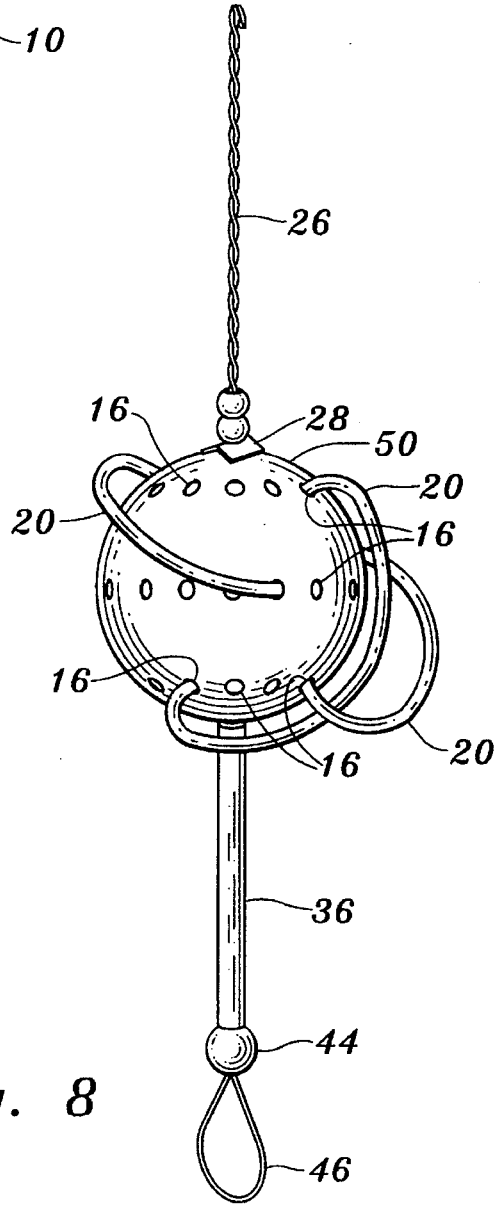
FIG. 8 is a view similar to FIG. 1 but illustrating an alternative embodiment of the apparatus.

FIG. 8 illustrates another embodiment of the invention wherein the rotatable support is in the form of a hollow sphere 50 having a plurality of openings 16 spaced from each other and from the rotational axis of the sphere 50 about elongated structural element 26. In the embodiment disclosed in FIG. 8, three elongated flexible members 20 have the ends thereof projecting through two spaced openings 16 and into the hollow interior of sphere 50. The portions of the elongated flexible members external of the sphere 50 are bowed and form arches which change shapes as the sphere is rotated in a manner described above with respect to the first embodiment of the invention.

I claim:

1. Amusement and recreational apparatus comprising in combination:

a rotatable support rotatable about a support axis of rotation and defining at least one opening spaced from the support axis of rotation;

at least one elongated flexible member in engagement with and supported by said rotatable support, said at least one elongated flexible member having a flexible light transmitting portion spaced from said rotatable support and defining an interior closed to the ambient atmosphere;

chemiluminescent liquid material within the interior of said flexible light transmitting portion, said at least one elongated flexible member extending through said at least one opening defined by said rotatable support spaced from the support axis of rotation and said flexible light transmitting portion projecting from said at least one opening spaced from the support axis of rotation whereby rotation of said rotatable support causes said flexible light transmitting portion to flex and move outwardly away from said support axis of rotation under centrifugal force to provide a variable light display from chemiluminescent light material within the interior of said flexible light transmitting portion; and means for imparting rotational movement to said rotatable support and said at least one elongated flexible member in engagement with and supported by said rotatable support, said means for imparting rotational movement to said rotatable support including an elongated structural element extending through said rotatable support and engagement means engaging said elongated structural element and said rotatable support and cooperable with said elongated structural element and said rotatable support for causing rotational movement of said rotatable support when said engagement means moves said rotatable support axially along said elongated structural element.

2. Amusement and recreational apparatus comprising in combination:

a rotatable support rotatable about a support axis of rotation and defining at least one opening spaced from the support axis of rotation;

at least one elongated flexible member in engagement with and supported by said rotatable support, said at least one elongated flexible member having a flexible light transmitting portion spaced from said rotatable support and defining an interior closed to the ambient atmosphere;

chemiluminescent liquid material within the interior of said flexible light transmitting portion, said at least one elongated flexible member extending through said at least one opening defined by said rotatable support spaced from the support axis of rotation and said flexible light transmitting portion projecting from said at least one opening spaced from the support axis of rotation whereby rotation of said rotatable support causes said flexible light transmitting portion to flex and move outwardly away from said support axis of rotation under centrifugal force to provide a variable light display from chemiluminescent light material within the interior of said flexible light transmitting portion; and means for imparting rotational movement to said rotatable support and said at least one elongated flexible member in engagement with and supported by said rotatable support, said rotatable support defining a plurality of openings spaced from one another and from the support axis of rotation, said at least one elongated flexible member being woven through at least two of said openings.

3. The amusement and recreational apparatus according to claim 2 wherein said rotatable support includes two opposed sides, said at least one elongated flexible member extending outwardly from each of said opposed sides.

4. The amusement and recreational apparatus according to claim 2 wherein said rotatable support is hollow and defines an interior, said at least one opening communicating with said interior and said at least one elongated flexible member projecting into said interior.

5. The amusement and recreational apparatus according to claim 2 wherein said at least one elongated flexible member includes two ends, at least one of said ends being spaced from the support axis of rotation and moveable relative to said rotatable support whereby said at least one end moves outwardly under centrifugal force upon rotation of said rotatable support by said means for imparting rotational movement to said rotatable support.

6. The amusement and recreational apparatus according to claim 2 wherein said rotatable support defines a plurality of openings spaced from one another and from the support axis of rotation, and wherein at least two elongated flexible members are in engagement with said rotatable support and pass through different openings defined by said rotatable support.

7. The amusement and recreational apparatus according to claim 5 wherein both tube ends of said at least one elongated flexible member are spaced from the support axis of rotation and are spaced from said rotatable support whereby both of said ends move outwardly under centrifugal force upon rotation of said rotatable support by said means for imparting rotational movement to said rotatable support.

8. The amusement and recreational apparatus according to claim 2 wherein said means for imparting rotational movement to said rotatable support includes an elongated structural element extending through said rotatable support and engagement means engaging said elongated structural element and said rotatable support and cooperable with said elongated structural element and said rotatable support for causing rotational movement of said rotatable support when said engagement means moves said rotatable support axially along said elongated structural element.

9. The amusement and recreational apparatus according to claim 2 wherein said rotatable support defines at least two openings spaced from the support axis of rotation, said at least one elongated flexible member extending through said at least two openings and said flexible light transmitting portion being bowed and forming an arch extending between said at least two openings, said flexible light transmitting portion flexing under centrifugal force upon rotation of said rotatable support about said support axis of rotation to change the shape of said arch.

10. The amusement and recreational apparatus according to claim 2 wherein said at least one elongated flexible member has a tube-like configuration.

11. Amusement and recreational apparatus comprising in combination:

a rotatable support rotatable about a support axis of rotation and defining a plurality of openings spaced from each other and from the support axis of rotation;

at least one elongated flexible member in frictional engagement with and supported by said rotatable support, said at least one elongated flexible member being woven through said openings, adjustable relative to said rotatable support and having a flexible light transmitting portion spaced from said rotatable support and defining an interior closed to the ambient atmosphere;

chemiluminescent liquid material within the interior of said flexible light transmitting portion, said flexible light transmitting portion projecting from said openings and spaced from the support axis of rotation to provide a light display from chemiluminescent light material within the interior of said flexible light transmitting portion; and means for imparting rotational movement to said rotatable support and said at least one elongated flexible member in frictional engagement with and supported by said rotatable support.

12. Amusement and recreational apparatus comprising in combination:

a rotatable support rotatable about a support axis of rotation and defining at least one opening spaced from the support axis of rotation;

at least one elongated flexible member in engagement with and supported by said rotatable support, said at least one elongated flexible member having a flexible light transmitting portion spaced from said rotatable support and defining an interior closed to the ambient atmosphere;

chemiluminescent liquid material within the interior of said flexible light transmitting portion, said at least one elongated flexible member extending through said at least one opening defined by said rotatable support spaced from the support axis of rotation and said flexible light transmitting portion projecting from said at least one opening spaced from the support axis of rotation whereby rotation of said rotatable support causes said flexible light transmitting portion to flex and move outwardly away from said support axis of rotation under centrifugal force to provide a variable light display from chemiluminescent light material within the interior of said flexible light transmitting portion; and means for imparting rotational movement to said rotatable support and said at least one elongated flexible member in engagement with and supported by said rotatable support, said at least one elongated flexible member including two ends, both ends of said at least one elongated flexible member being spaced from the support axis of rotation, moveable relative to said rotatable support, and spaced from said rotatable support whereby both of said ends move outwardly under centrifugal force upon rotation of said rotatable support by said means for imparting rotational movement to said rotatable support.

* * * * *